US008764547B2

(12) United States Patent
Katyal

(10) Patent No.: US 8,764,547 B2
(45) Date of Patent: Jul. 1, 2014

(54) METHOD OF GAMING, A GAMING SYSTEM, AND A GAME CONTROLLER

(75) Inventor: Garima Katyal, Girraween NSW (AU)

(73) Assignee: Aristocrat Technologies Australia Pty Limited (AU)

( * ) Notice: Subject to any disclaimer, the term of this patent is extended or adjusted under 35 U.S.C. 154(b) by 124 days.

(21) Appl. No.: 13/205,915

(22) Filed: Aug. 9, 2011

(65) Prior Publication Data

US 2012/0040735 A1 Feb. 16, 2012

(30) Foreign Application Priority Data

Aug. 10, 2010 (AU) ..... 2010903575

(51) Int. Cl.
*A63F 9/24* (2006.01)

(52) U.S. Cl.
USPC ..... 463/20; 463/21; 463/30

(58) Field of Classification Search
USPC ..... 463/20, 21, 30
See application file for complete search history.

(56) References Cited

U.S. PATENT DOCUMENTS

| | | | |
|---|---|---|---|
| 4,743,024 | A | 5/1988 | Helm et al. |
| 4,826,169 | A | 5/1989 | Bessho et al. |
| 5,476,259 | A | 12/1995 | Weingardt |
| RE35,864 | E | 7/1998 | Weingardt |
| 6,210,275 | B1 | 4/2001 | Olsen |
| 6,270,409 | B1 | 8/2001 | Shuster |
| 6,270,412 | B1 | 8/2001 | Crawford et al. |
| 6,358,150 | B1 | 3/2002 | Mir et al. |
| 6,375,570 | B1 | 4/2002 | Poole |
| 6,450,887 | B1 | 9/2002 | Mir et al. |
| 6,641,477 | B1 | 11/2003 | Dietz, II |
| 6,702,675 | B2 | 3/2004 | Poole et al. |
| 6,811,486 | B1 | 11/2004 | Luciano, Jr. |
| 6,875,106 | B2 | 4/2005 | Weiss et al. |
| 6,890,257 | B2 | 5/2005 | Baerlocher |
| 7,198,569 | B2 | 4/2007 | Wolf et al. |
| 7,300,351 | B2 | 11/2007 | Thomas |
| 7,322,887 | B2 | 1/2008 | Belger et al. |
| 7,326,115 | B2 | 2/2008 | Baerlocher |
| 7,331,864 | B2 | 2/2008 | Baerlocher |
| 7,371,166 | B1 | 5/2008 | Webb et al. |
| 7,371,173 | B2 | 5/2008 | Gatto et al. |
| 7,585,222 | B2 | 9/2009 | Muir |
| 2002/0045482 | A1 | 4/2002 | Poole |
| 2002/0155883 | A1 | 10/2002 | Baerlocher |
| 2002/0173353 | A1 | 11/2002 | Thomas |

(Continued)

FOREIGN PATENT DOCUMENTS

| | | | |
|---|---|---|---|
| AU | 2000/071497 | A1 | 5/2001 |
| AU | 2002/251743 | A1 | 2/2003 |

(Continued)

*Primary Examiner* — Pierre E Elisca
(74) *Attorney, Agent, or Firm* — McAndrews, Held & Malloy, Ltd.

(57) ABSTRACT

There is disclosed a gaming system comprising a display 54, a symbol selector 623, a symbol evaluator 625 and a symbols modifier 626. The symbol selector 623 is arranged to select a plurality of sets of symbols for display on the display. The symbol evaluator 625 is arranged to determine whether the displayed symbols include any winning symbol combination. The symbol modifier 626 is arranged to, only upon a determination that the displayed symbols do not include any winning symbol combination, repeatedly apply a modification rule to at least one of the plurality of sets of symbols until the displayed symbols include any winning symbol combination.

46 Claims, 7 Drawing Sheets

(56) References Cited

U.S. PATENT DOCUMENTS

| | | | |
|---|---|---|---|
| 2003/0008698 | A1 | 1/2003 | Stone |
| 2003/0032470 | A1 | 2/2003 | Weiss et al. |
| 2003/0036424 | A1 | 2/2003 | Baerlocher |
| 2003/0073499 | A1 | 4/2003 | Reece |
| 2003/0104857 | A1 | 6/2003 | Jenkins |
| 2004/0002377 | A1 | 1/2004 | Staw et al. |
| 2004/0063483 | A1 | 4/2004 | Wolf et al. |
| 2004/0077396 | A1 | 4/2004 | Poole et al. |
| 2004/0137980 | A1 | 7/2004 | Aenlle |
| 2004/0176157 | A1 | 9/2004 | Walker et al. |
| 2004/0266516 | A1 | 12/2004 | Thomas |
| 2004/0266517 | A1 | 12/2004 | Bleich et al. |
| 2005/0020346 | A1 | 1/2005 | Baerlocher |
| 2005/0192081 | A1 | 9/2005 | Marks et al. |
| 2006/0025201 | A1 | 2/2006 | Van Asdale |
| 2006/0040735 | A1 | 2/2006 | Baerlocher |
| 2006/0046830 | A1 | 3/2006 | Webb |
| 2006/0084486 | A1 | 4/2006 | Belger et al. |
| 2006/0084492 | A1 | 4/2006 | Baerlocher et al. |
| 2006/0084493 | A1 | 4/2006 | Pederson et al. |
| 2006/0084498 | A1 | 4/2006 | Baerlocher et al. |
| 2006/0183530 | A1 | 8/2006 | Ellis |
| 2006/0189377 | A1 | 8/2006 | Gomez et al. |
| 2006/0189380 | A1 | 8/2006 | Schultz et al. |
| 2006/0258422 | A1 | 11/2006 | Walker et al. |
| 2006/0271433 | A1 | 11/2006 | Hughes |
| 2007/0060247 | A1 | 3/2007 | Low et al. |
| 2007/0060254 | A1 | 3/2007 | Muir |
| 2007/0161424 | A1 | 7/2007 | Gatto et al. |
| 2007/0167210 | A1 | 7/2007 | Kelly et al. |
| 2007/0167223 | A1 | 7/2007 | Bleich et al. |
| 2007/0167226 | A1 | 7/2007 | Kelly et al. |
| 2007/0232384 | A1 | 10/2007 | Pace |
| 2007/0259709 | A1 | 11/2007 | Kelly et al. |
| 2008/0076532 | A1 | 3/2008 | Graham et al. |
| 2008/0076534 | A1 | 3/2008 | Iddings et al. |
| 2008/0076542 | A1 | 3/2008 | Iddings et al. |
| 2008/0076576 | A1 | 3/2008 | Graham et al. |
| 2008/0085771 | A1 | 4/2008 | Iddings et al. |
| 2008/0085772 | A1 | 4/2008 | Iddings et al. |
| 2008/0113761 | A1 | 5/2008 | Belger et al. |
| 2008/0119283 | A1 | 5/2008 | Baerlocher |
| 2008/0153578 | A1 | 6/2008 | Gatto et al. |
| 2008/0153586 | A1 | 6/2008 | Gatto et al. |
| 2008/0214286 | A1 | 9/2008 | Lutnick et al. |
| 2008/0254881 | A1 | 10/2008 | Lutnick et al. |
| 2008/0254883 | A1 | 10/2008 | Patel et al. |
| 2008/0254893 | A1 | 10/2008 | Patel et al. |
| 2009/0061977 | A1 | 3/2009 | Brandt et al. |
| 2009/0093300 | A1 | 4/2009 | Lutnick et al. |
| 2009/0104960 | A1 | 4/2009 | Kelly et al. |
| 2009/0104987 | A1 | 4/2009 | Kelly et al. |
| 2009/0121434 | A1 | 5/2009 | Baerlocher et al. |
| 2009/0121474 | A1 | 5/2009 | Hughes |
| 2009/0124316 | A1 | 5/2009 | Baerlocher et al. |
| 2009/0124357 | A1 | 5/2009 | Acres |
| 2009/0124358 | A1 | 5/2009 | Acres |
| 2009/0131175 | A1 | 5/2009 | Kelly et al. |
| 2009/0163268 | A1 | 6/2009 | Lyons et al. |
| 2009/0191952 | A1 | 7/2009 | Nagano |
| 2009/0209318 | A1 | 8/2009 | Nguyen |
| 2009/0227354 | A1 | 9/2009 | Johnson |
| 2009/0233686 | A1* | 9/2009 | Nguyen ..... 463/20 |
| 2009/0239601 | A1 | 9/2009 | Macke |
| 2009/0239604 | A1 | 9/2009 | Acres |
| 2009/0239648 | A1 | 9/2009 | Acres |
| 2010/0004056 | A1 | 1/2010 | Walker |
| 2012/0040736 | A1* | 2/2012 | Penacho et al. ..... 463/20 |

FOREIGN PATENT DOCUMENTS

| | | | |
|---|---|---|---|
| AU | 2002/336431 | A1 | 6/2003 |
| AU | 2003/248423 | A1 | 4/2004 |
| AU | 2004/216719 | A1 | 9/2004 |
| AU | 780806 | B2 | 4/2005 |
| AU | 2005/208971 | A1 | 8/2005 |
| AU | 2003/248423 | B2 | 3/2006 |
| AU | 2005/218025 | A1 | 4/2006 |
| AU | 2005/292489 | A1 | 4/2006 |
| AU | 2006/287354 | A1 | 3/2007 |
| AU | 2007/240164 | A1 | 1/2008 |
| AU | 2004/216719 | B2 | 4/2008 |
| AU | 2008/201917 | A1 | 12/2008 |
| AU | 2008/202840 | A1 | 1/2009 |
| AU | 2009/200230 | A1 | 8/2009 |
| EP | 0233298 | B1 | 11/1992 |
| EP | 0060018 | B1 | 12/1996 |
| EP | 0558307 | B1 | 9/1998 |
| EP | 0609970 | B1 | 7/2001 |
| WO | 00/025876 | A1 | 5/2000 |
| WO | 01/091872 | A1 | 12/2001 |
| WO | 02/062439 | A1 | 8/2002 |
| WO | 03/009913 | A1 | 2/2003 |
| WO | 03/026756 | A1 | 4/2003 |
| WO | 2004/079670 | A2 | 9/2004 |
| WO | 2005/037387 | A1 | 4/2005 |
| WO | 2006/023907 | A2 | 3/2006 |
| WO | 2006/028860 | A2 | 3/2006 |
| WO | 2006/036516 | A2 | 4/2006 |
| WO | 2006/039082 | A2 | 4/2006 |
| WO | 2006/028860 | A3 | 12/2006 |
| WO | 2007/030766 | A2 | 3/2007 |
| WO | 2007/081377 | A2 | 7/2007 |
| WO | 2007/081377 | A3 | 12/2007 |
| WO | 20081005351 | A2 | 1/2008 |
| WO | 20071081377 | B1 | 2/2008 |
| WO | 20081024705 | A2 | 2/2008 |
| WO | 2005072443 | A2 | 8/2008 |
| WO | 20081109313 | A1 | 9/2008 |
| WO | 20091029934 | A2 | 3/2009 |
| WO | 20091032598 | A1 | 3/2009 |
| WO | 20091062187 | A1 | 5/2009 |

* cited by examiner

| | | | | |
|---|---|---|---|---|
| A | Q | A | 9 | 9 |
| PIC1 | K | K | 10 | K |
| PIC2 | PIC3 | PIC2 | PIC4 | 10 |
| | PIC1 | PIC4 | Q | 9 |

Figure 8A

| | | | | |
|---|---|---|---|---|
| A | K | K | 10 | K |
| PIC1 | PIC3 | PIC2 | PIC4 | 10 |
| PIC2 | PIC1 | PIC4 | Q | 9 |

Figure 8B

METHOD OF GAMING, A GAMING SYSTEM, AND A GAME CONTROLLER

RELATED APPLICATIONS

This application claims priority to Australian Patent Application No. 2010903575 having a filing date of Aug. 10, 2010, which is incorporated herein by reference in its entirety.

BACKGROUND OF THE INVENTION

The present invention relates to an electronic method of gaming, a gaming system, and a game controller.

In many gaming venues, spinning-reel type games are available in stand alone gaming machines. In such games, a player is typically awarded a prize only if there is a winning symbol combination. Conventionally, only a small proportion of possible symbol combinations in these games are winning symbol combinations. As a result, even if a player has played a large number of games, the player may not be awarded a prize. To provide enjoyment, additional features such as special symbols, free games or re-spins are sometimes incorporated in the games.

While such gaming systems provide players with enjoyment, a need exists for alternative gaming systems in order to maintain or increase player enjoyment.

BRIEF SUMMARY OF THE INVENTION

In a first aspect, the invention provides an electronic method of gaming, comprising:

(a) selecting a plurality of sets of symbols for display on a display;

(b) determining whether the displayed symbols include any winning symbol combination; and (c) only upon determining that the displayed symbols do not include any winning symbol combination, repeatedly applying a modification rule to at least one of the plurality of sets of symbols until the displayed symbols include any winning symbol combination.

In an embodiment, each set of symbols is displayed on the display at respective ones of a plurality of columns of display positions.

In an embodiment, each symbol is selected from a predetermined set of symbols representing a reel of symbols.

In an embodiment, the reel is a physical, substantially circular reel.

In an embodiment, the reel is implemented in software as a virtual reel.

In an embodiment, the modification rule is that one of the reels is rotated.

In an embodiment, the modification rule is that a plurality of reels are rotated.

In an embodiment, the modification rule is that the predetermined set of symbols of one of the plurality of reels of symbols is replaced by a separate predetermined set of symbols.

In an embodiment, the electronic method further comprises (d) making an award corresponding to the winning symbol combination.

In an embodiment, the electronic method further comprises conducting a base game and determining whether a trigger condition is met in the base game, and wherein steps (a) to (d) are carried out as part of a feature game upon the trigger condition being met in the base game.

In an embodiment, the feature game comprises a series of free games, and steps (a) to (d) are carried out during each of the free games.

In an embodiment, the electronic method further comprises reverting back to the base game upon the completion of the series of free games.

In an embodiment, there are a plurality of trigger conditions and the number of free games is dependent on which of the trigger conditions occurs.

In an embodiment, the base game is a spinning-reel type game.

In an embodiment, the trigger condition is that there is a scatter combination.

In a second aspect, the invention provides a gaming system, comprising:

a display;

a symbol selector arranged to select a plurality of sets of symbols for display on the display;

a symbol evaluator arranged to determine whether the displayed symbols include any winning symbol combination; and a symbol modifier arranged to, only upon a determination that the displayed symbols do not include any winning symbol combination, repeatedly apply a modification rule to at least one of the plurality of sets of symbols until the displayed symbols include any winning symbol combination.

In an embodiment, each set of symbols is displayed on the display at respective ones of a plurality of columns of display positions.

In an embodiment, each symbol is selected from a predetermined set of symbols representing a reel of symbols.

In an embodiment, the reel is a physical, substantially circular reel.

In an embodiment, the reel is implemented in software as a virtual reel.

In an embodiment, the modification rule is that one of the reels is rotated.

In an embodiment, the modification rule is that a plurality of reels is rotated.

In an embodiment, the modification rule is that the predetermined set of symbols of one of the plurality of reels of symbols is replaced by a separate predetermined set of symbols.

In an embodiment, the gaming system is arranged to make an award.

In an embodiment, the gaming system is arranged to conduct a base game and a feature game, the symbol evaluator comprises a trigger monitor arranged to determine whether a trigger condition is met in the base game, and the symbol modifier is arranged to apply the modification rule only during the feature game.

In an embodiment, the feature game comprises a series of free games.

In an embodiment, the gaming system is arranged to revert back to the base game upon the completion of the series of free games.

In an embodiment, there are a plurality of trigger conditions and the number of free games is dependent on which of the trigger conditions occurs.

In an embodiment, the base game is a spinning-reel type game.

In an embodiment, the trigger condition is that there is a scatter combination.

In a third aspect, the invention provides a game controller for a gaming system, the game controller arranged to:

select a plurality of sets of symbols for display on a display;

determine whether the displayed symbols include any winning symbol combination; and only upon determining that the displayed symbols do not include any winning symbol combination, repeatedly apply a modification rule to at least one of the plurality of sets of symbols until the displayed symbols include any winning symbol combination.

In an embodiment, each set of symbols is displayed on the display at respective ones of a plurality of columns of display positions.

In an embodiment, each symbol is selected from a predetermined set of symbols representing a reel of symbols.

In an embodiment, the reel is a physical, substantially circular reel.

In an embodiment, the reel is implemented in software as a virtual reel.

In an embodiment, the modification rule is that one of the reels is rotated.

In an embodiment, the modification rule is that a plurality of reels are rotated.

In an embodiment, the modification rule is that the predetermined set of symbols of one of the plurality of reels of symbols are replaced by a separate predetermined set of symbols.

In an embodiment, the game controller is arranged to make an award corresponding to the winning symbol combination.

In an embodiment, the game controller is arranged to:

conduct a base game and a feature game;

determine whether a trigger condition is met in the base game; and apply the modification rule only during the feature game.

In an embodiment, the feature game comprises a series of free games.

In an embodiment, the game controller is arranged to revert back to the base game upon the completion of the series of free games.

In an embodiment, there are a plurality of trigger conditions and the number of free games is dependent on which of the trigger conditions occurs.

In an embodiment, the base game is a spinning-reel type game.

In an embodiment, the trigger condition is that there is a scatter combination.

In a fourth aspect, the invention provides a gaming machine comprising:

a cabinet;

a display mounted to the cabinet for displaying a plurality of sets of symbols to a player;

a game play mechanism mounted to the cabinet, the game play mechanism operable by the player to initiate a play of a game; and a game controller mounted within the cabinet and communicatively coupled to the display and the game play mechanism, the game controller comprising:

a symbol selector arranged to select the plurality of sets of symbols for display on the display to the player;

a symbol evaluator arranged to determine whether the displayed symbols on the display include any winning symbol combination; and a symbol modifier arranged to, only upon a determination that the displayed symbols on the display do not include any winning symbol combination, repeatedly apply a modification rule to at least one of the plurality of sets of symbols until the displayed symbols on the display include any winning symbol combination.

In a fifth aspect, the invention provides computer program code which when executed implements the above method.

In a sixth aspect, the invention provides a tangible computer readable medium comprising the above program code.

In a seventh aspect, the invention provides a data signal comprising the above program code.

In an eighth aspect, the invention extends to transmitting the above program code.

BRIEF DESCRIPTION OF SEVERAL VIEWS OF THE DRAWINGS

An exemplary embodiment of the invention will now be described with reference to the accompanying drawings in which:

FIGS. 8A and 8B are diagrammatic representations of an example of a game.

DETAILED DESCRIPTION OF THE INVENTION

Figure 1:
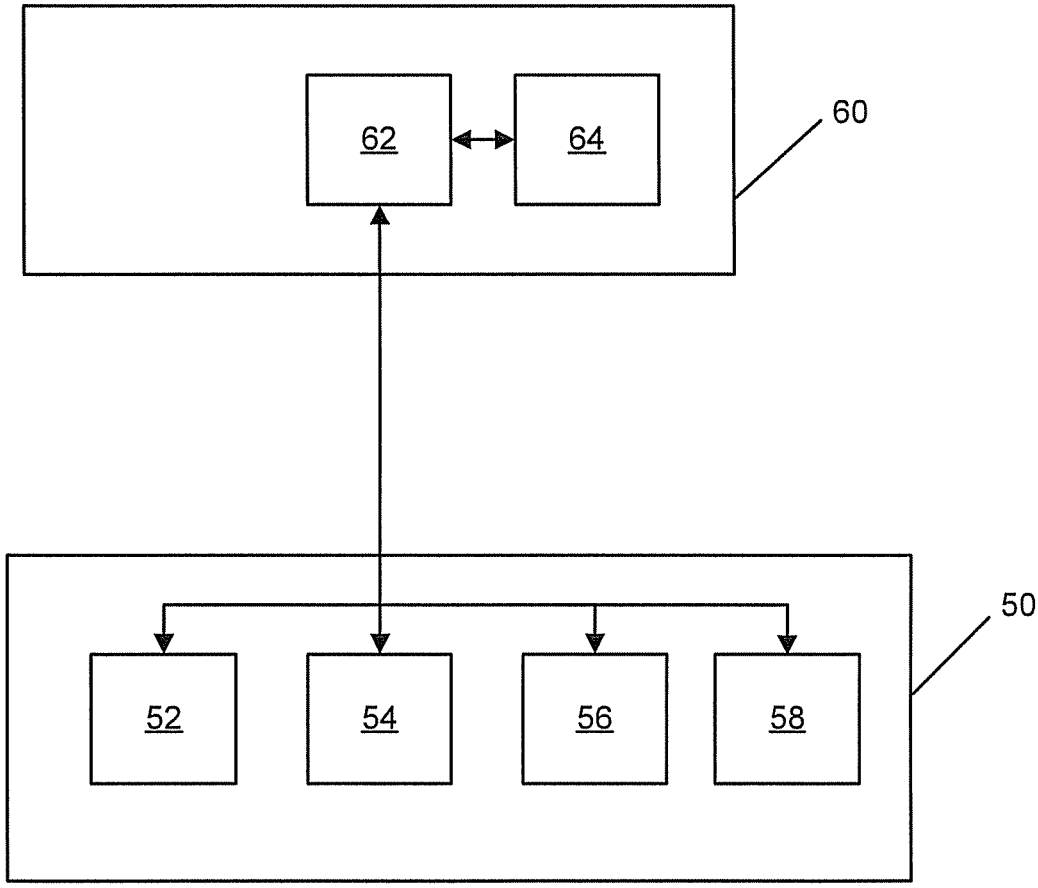
FIG. 1 is a block diagram of the core components of a gaming system.

Referring to the drawings, there is shown a gaming system arranged to implement a game where symbols are selected and displayed at a plurality of display positions on a display. During game play, for example, during a feature game comprising a series of free games, a modification rule is repeatedly applied to one or more of the symbols immediately upon a determination that the displayed symbols do not include any winning symbol combination.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
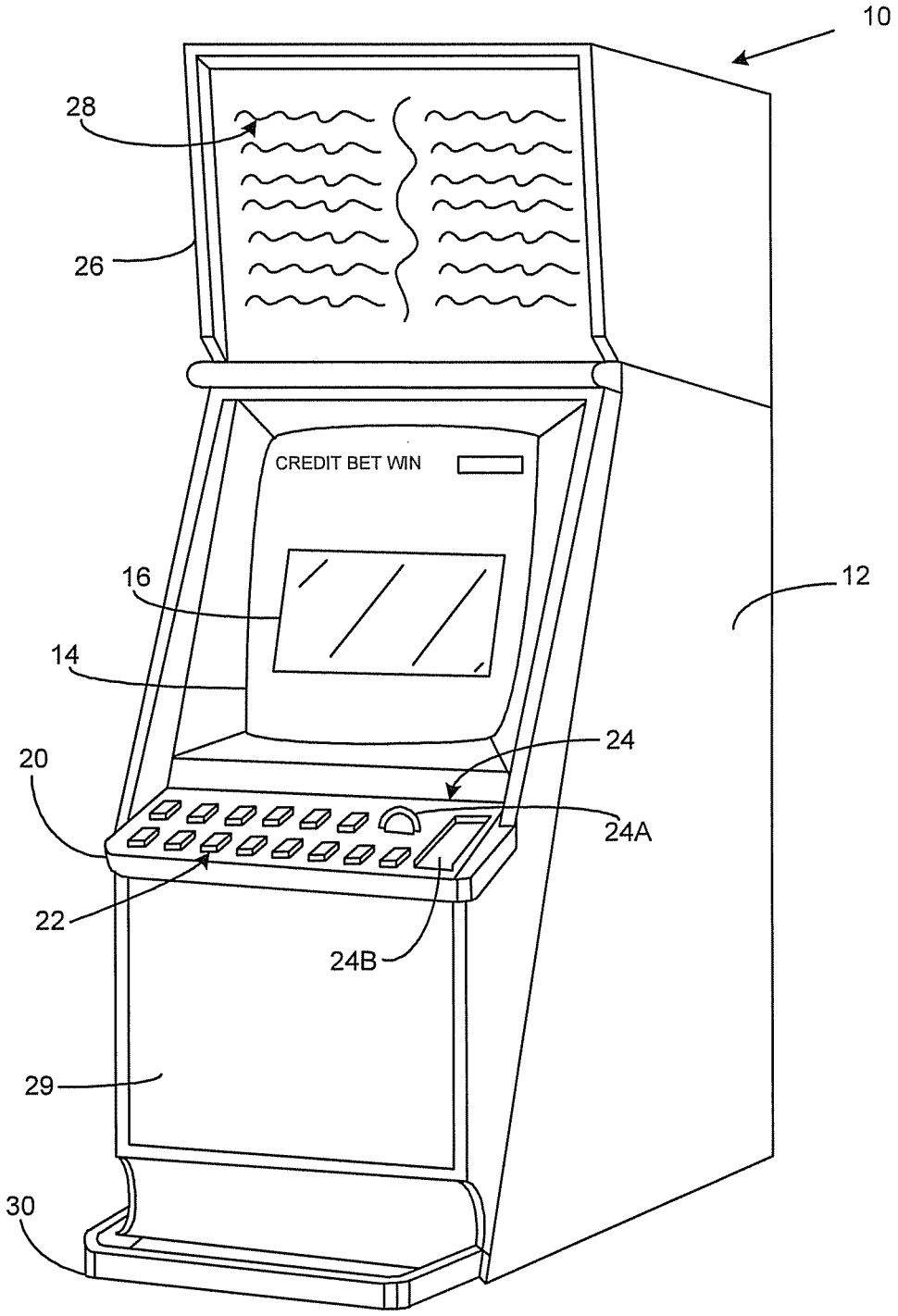
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
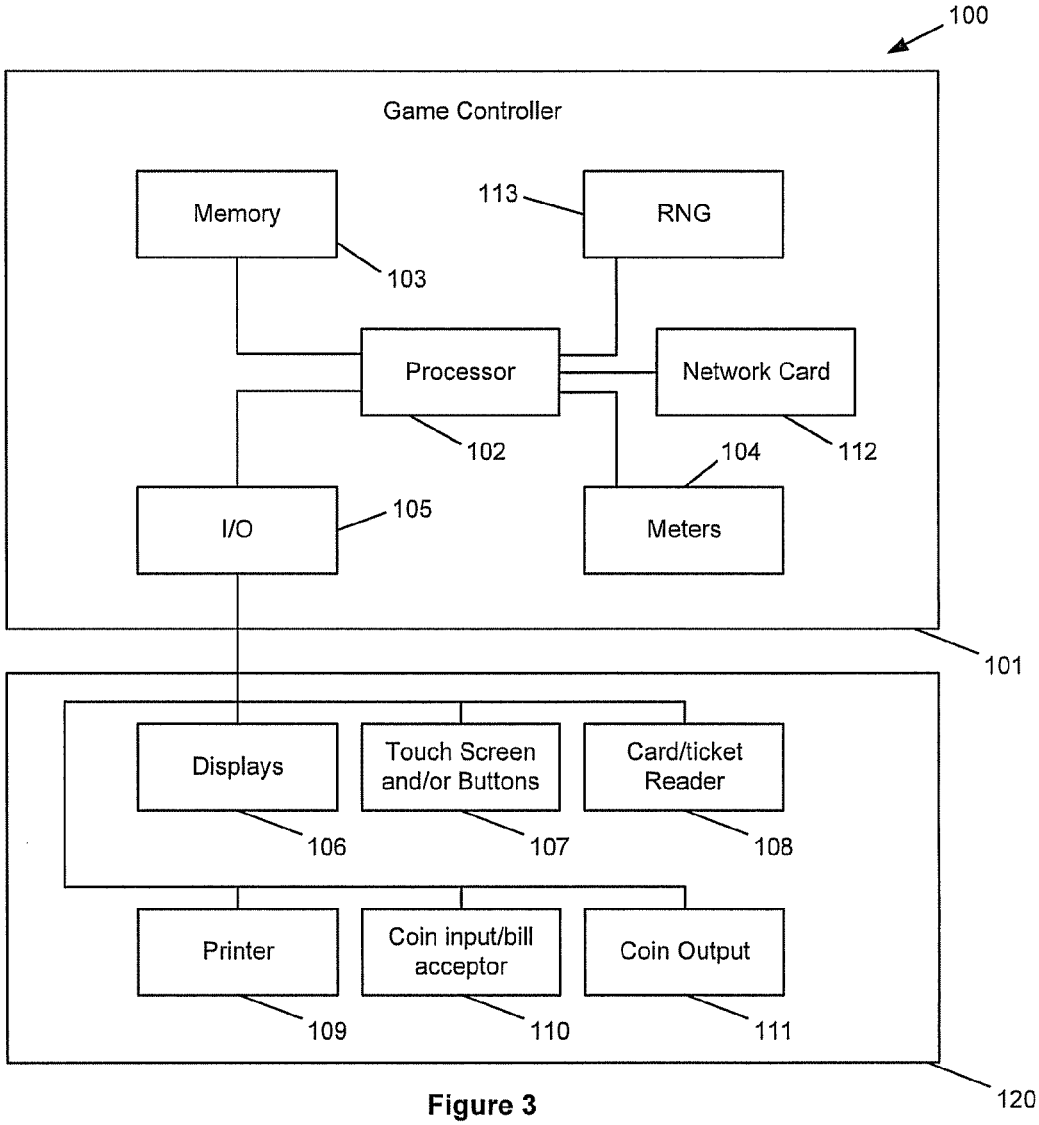
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
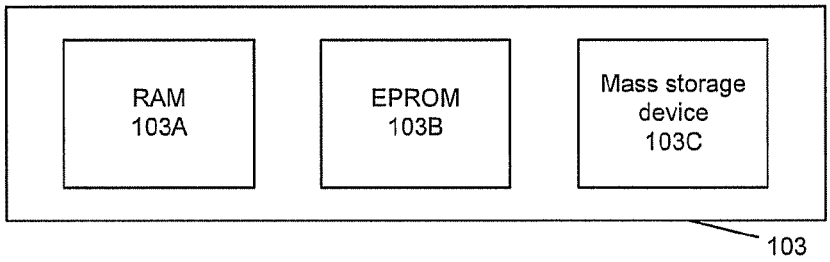
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/ output devices 106,107,108,109,110,111 to be provided remotely from the game controller 101.

Figure 5:
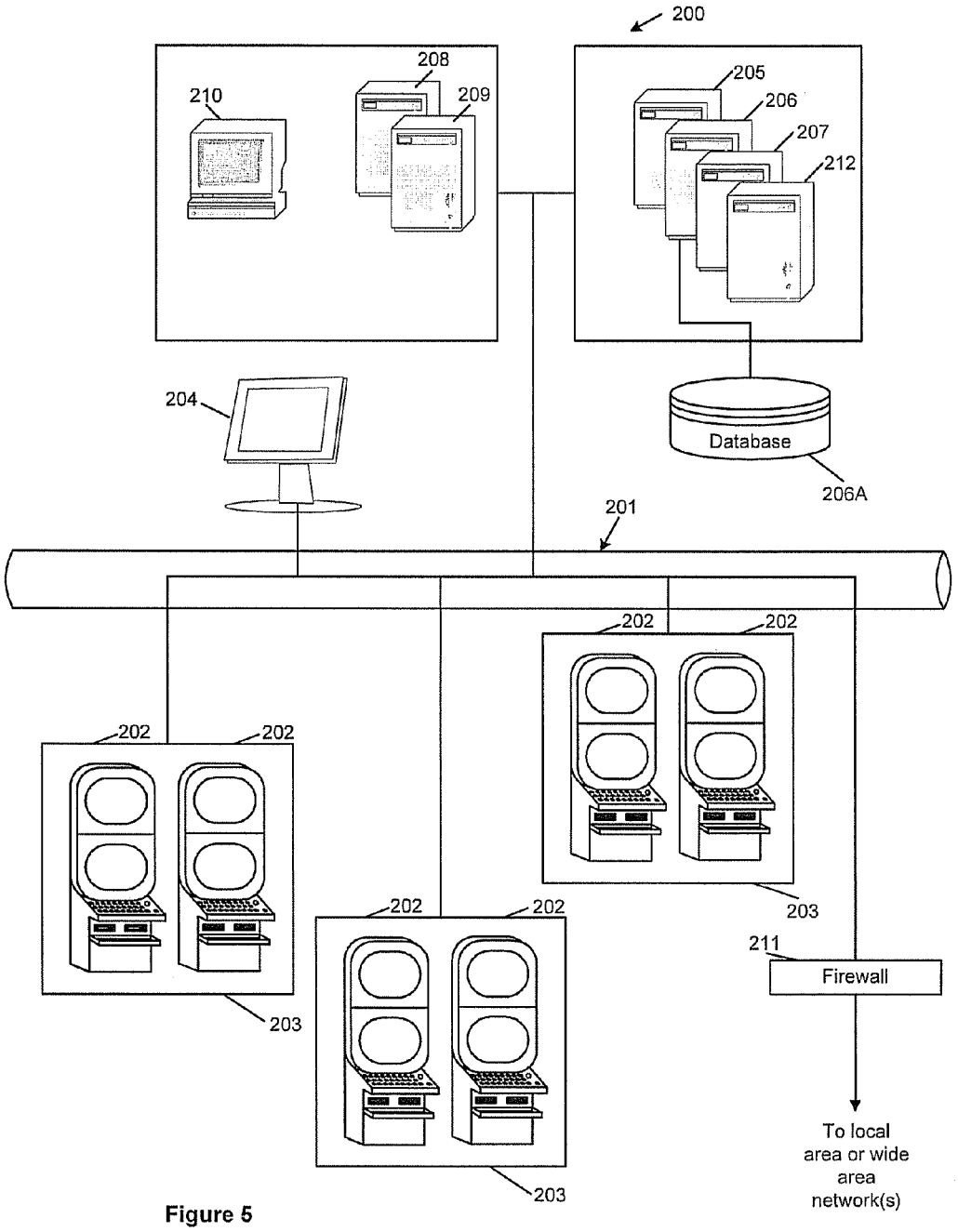
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Details of Gaming System

Figure 6:
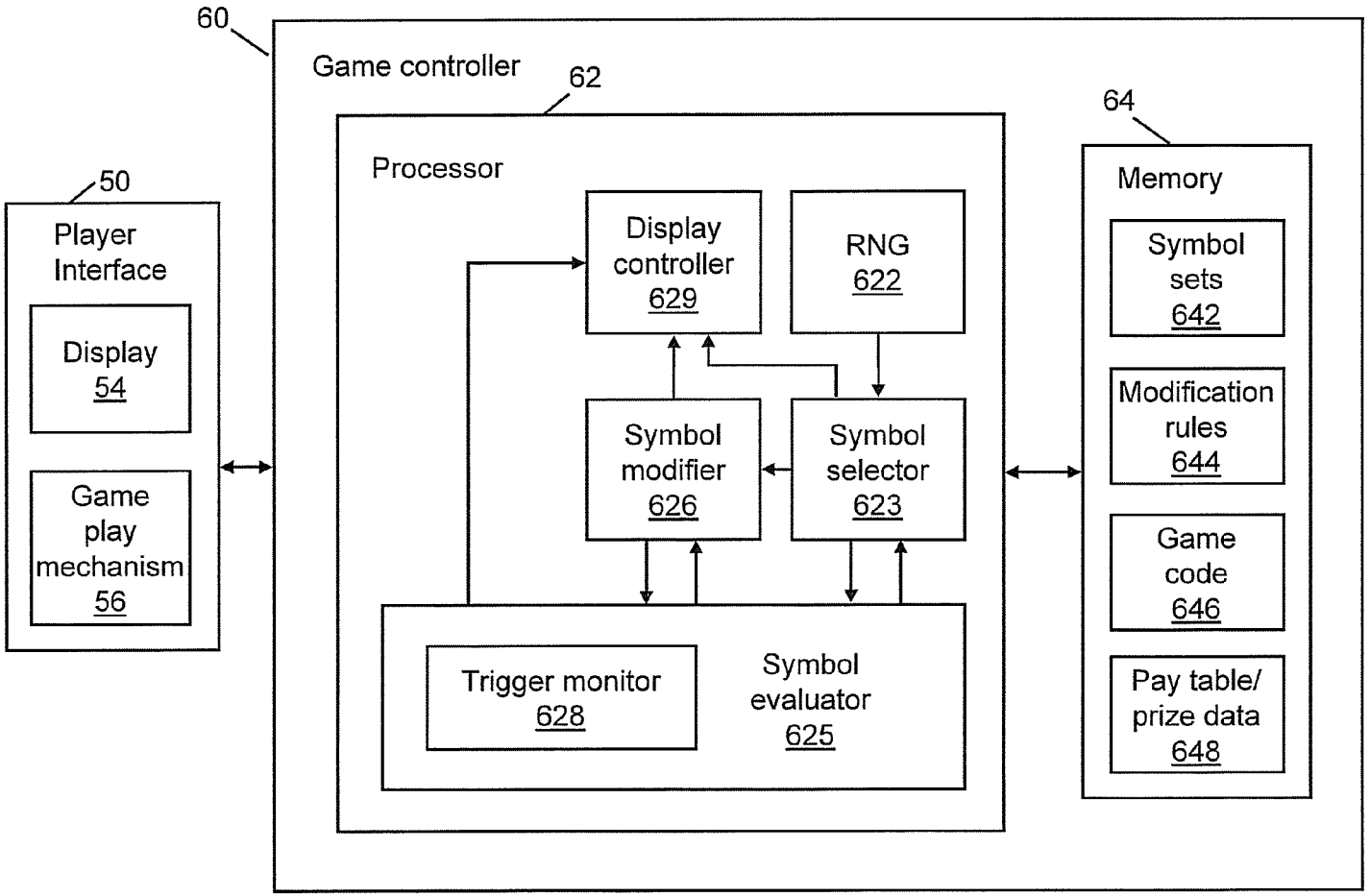
FIG. 6 is a further block diagram of a gaming system.

FIG. 6 shows the functional components of an embodiment of the gaming system having a game controller 60 comprising a processor 62 arranged to implement a number of modules based on game code 646 and data stored in memory 64. Persons skilled in the art will appreciate that the modules are typically implemented using a processor based on code and data stored in memory but that one or more of the modules could alternatively be implemented in some other way, for example by a dedicated circuit.

In the embodiment, the gaming system is arranged to conduct a base game and a feature game. In the embodiment, the feature game is a free game series (that is, a series of free games) and the feature game is initiated or awarded upon a trigger condition being met in the base game. In this respect, persons skilled in the art will appreciate that the base game is a part of the game which is carried out each time the player makes a wager and initiates a play of the game whereas a feature game is a part of the game which will only be carried out occasionally upon a trigger condition being met. That is, a feature game involves some additional element of game play which only occurs when a trigger condition is met. Here, the feature game is in the form of "free games" which in the art means that a series of games like the base game are carried out for the player before the player needs to place a further wager and initiate play of the gaming machine again. In the embodiment, the game is a spinning reel game, and the free games are conducted by spinning each reel again, and evaluating the displayed symbols when then reels stop to determine whether the player is entitled to an award. Persons skilled in the art will appreciate that the concept of "free games" can include games where there is some modification to the game rules relative to the base game, for example, a multiplier is applied to awards, a symbol performs an additional function, the symbol set is changed etc.

Depending on the embodiment, the base and feature games can be line-based games or reel-based games. In a line-based game, a player's win entitlement is based on how many win lines the player plays in each game (for example, a minimum of one win line up to the maximum number of win lines allowed by the game) and how much they wager per line. Such win lines are typically formed by a combination of symbol display positions, one from each reel, the symbol display positions being located relative to one another such that they form a line. Persons skilled in the art will appreciate that in some line-based games, the player's win entitlement may not be strictly limited to the lines they have selected, for example, "scatter" pays can be awarded independently of a player's selection of pay lines and can be an inherent part of a win entitlement. In such games, a winning symbol combination must fall on a win line selected by the player (or otherwise be part of the win entitlement) for the player to be awarded the corresponding award.

In a reel-based game, a player obtains a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. Thus, for a 5×3 spinning-reel type game having five reels and fifteen display positions, there can be 243 ways to win, such that a player wins an award if a winning combination is covered by any one of these ways to win.

As discussed above, in the embodiment, both the base game and the free games are spinning-reel type games where during game play, symbols of reels are selected for display at a plurality of columns of display positions on a display 54. Persons skilled in the art will appreciate that the spinning-reel type game may vary in terms of the number of columns or the number of display positions per column. For example, the game may be a 4×6 spinning-reel type game having four columns, each column having six vertically adjacent display positions; a 5×3 spinning-reel type game having five columns, each column having three vertically adjacent display positions etc.

In the embodiment, the gaming system includes a player interface 50 and the player interface 50 comprises a game play mechanism 56 arranged to allow a player to input game instructions and to place wagers, and a display 54 arranged to display the games to the player.

The modules implemented by the processor 62 include a symbol selector 623, a symbol evaluator 625 and a symbol modifier 626.

The symbol selector 623 is arranged to select a symbol for display at each of the display positions on the display 54 during the free games and during the base game. In the embodiment, each symbol of a reel is part of a predetermined sequence of symbols specified in symbol sets 642 of memory 64. During game play, the symbol selector 623 selects the symbols for display at a column of display positions by selecting a stopping position in the sequence. In the embodiment, the stopping position is determined based on pseudo-random numbers generated by a Random Number Generator (RNG) 622. In the embodiment, the reels are implemented in software as virtual reels and a display controller 629 communicates to the player interface 50 to control the display 54 to display the selected symbols to the player. However, persons skilled in the art will appreciate that the reels may alternatively be electromechanical reels controlled by a stepper motor.

In the embodiment, the symbol evaluator 625 comprises a trigger monitor 628 arranged to determine whether a trigger condition is met in the base game. In the embodiment, the trigger condition is that there is a scatter combination in the base game. Persons skilled in the art will appreciate that the trigger condition may not be the occurrence of a scatter combination, for example, the trigger combination may alternatively be the occurrence of another symbol combination or be simply the occurrence of a specific symbol in the base game. Persons skilled in the art will also appreciate that a trigger condition may be purchased, be caused by another connected system, based on a random evaluation, etc.

In the embodiment, the gaming system is arranged to, upon a determination that a trigger combination is met in the base game, initiate a feature game by conducting a first one of a series of free game. That is, upon the determination that there is a scatter combination in the base game, the symbol selector 623 selects a new set of symbols for display at each of the display positions for the first free game. In the embodiment, the symbols that may be selected for the free games are specified in symbol sets 642 and are the same as those for the base game. However, as discussed above, it is envisaged that the symbols for the free games may be different to those for the base game in an alternative embodiment. In the embodiment, the number of free games can vary based on the number of symbols in the scatter combination. However, it is envisaged that in another embodiment, there may be only one trigger condition and the number of free games may be fixed. It is also envisaged that in an embodiment, the feature game may comprise only one free game.

In the embodiment, the symbol modifier 626 is arranged to, in each of the free games, repeatedly apply a modification rule to one or more of the sets of symbols displayed on the display 54 upon a determination by a non-win determiner 627 of the symbol evaluator 625 that the displayed symbols do not include any winning symbol combination which entitles the player to one of the awards specified in pay table 648. Thus, the symbol modifier 626 only acts when there is no winning symbol combination in the feature game. In the embodiment, the symbol modifier 626 is arranged to repeatedly apply a modification rule based on a plurality of modification rules stored in modification rules 644 of memory 64 until symbol evaluator 625 determines that the player has a winning combination, entitling the player to an award. In the embodiment, the awards are in credits and thus each award is added to a win meter stored in memory 64. The symbol modifier 626 in the embodiment can apply different modification rules in different games.

The modification rules may differ in terms of which columns of symbols (that is, the symbols displayed at different columns of display positions) may be modified. For example, according to one modification rule, the symbol modifier 626 may only modify the symbols displayed at the left-most column of display positions while according to another modification rule, the symbol modifier 626 may modify the symbols displayed at not only the left-most column of display positions but also at the right-most column of display positions.

Depending on which modification rule is applied, the manner in which symbols of a column are modified may also be different. For example, according to one modification rule, a column of symbols may be modified by rotating the reel associated with the column upward by one symbol. Persons skilled in the art will appreciate that different columns of symbols may be modified differently, for example, a first column of symbols may be modified by rotating the reel associated with the first column downwards by two symbols while a second column of symbols may be modified by rotating the reel associated with the second column upwards by one symbol.

In the embodiment, the symbol modifier 626 is arranged to select the modification rule from modification rules 644 of memory 64 randomly based on pseudo-random numbers from RNG 622. However, this need not always be the case, for example, in another embodiment, the symbol modifier 626 may be arranged to select the modification rule based on a predetermined sequence. It is also envisaged that in another embodiment, there may be only one modification rule and the same modification rule is always applied.

As discussed above, the symbol modifier 626 is arranged to apply a modification rule upon a determination that the displayed symbols do not include any winning symbol combination in each of the free games. In the embodiment, the symbol evaluator 625 comprises a no-win determiner 627 arranged to carry out this determination (of whether the displayed symbols do not include any winning symbol combination) during each free game. As indicated above, each award is added to the win meter.

In the embodiment, the gaming system is arranged to either continue on to the next free game (that is, by having the symbol selector 623 proceeding to select a new plurality of sets of symbols for display on the display 54) or, if all the free games have been played, transfer credits to the credit meter when the player starts another play of the game or cashes out (assuming no gamble feature).

Figure 7:
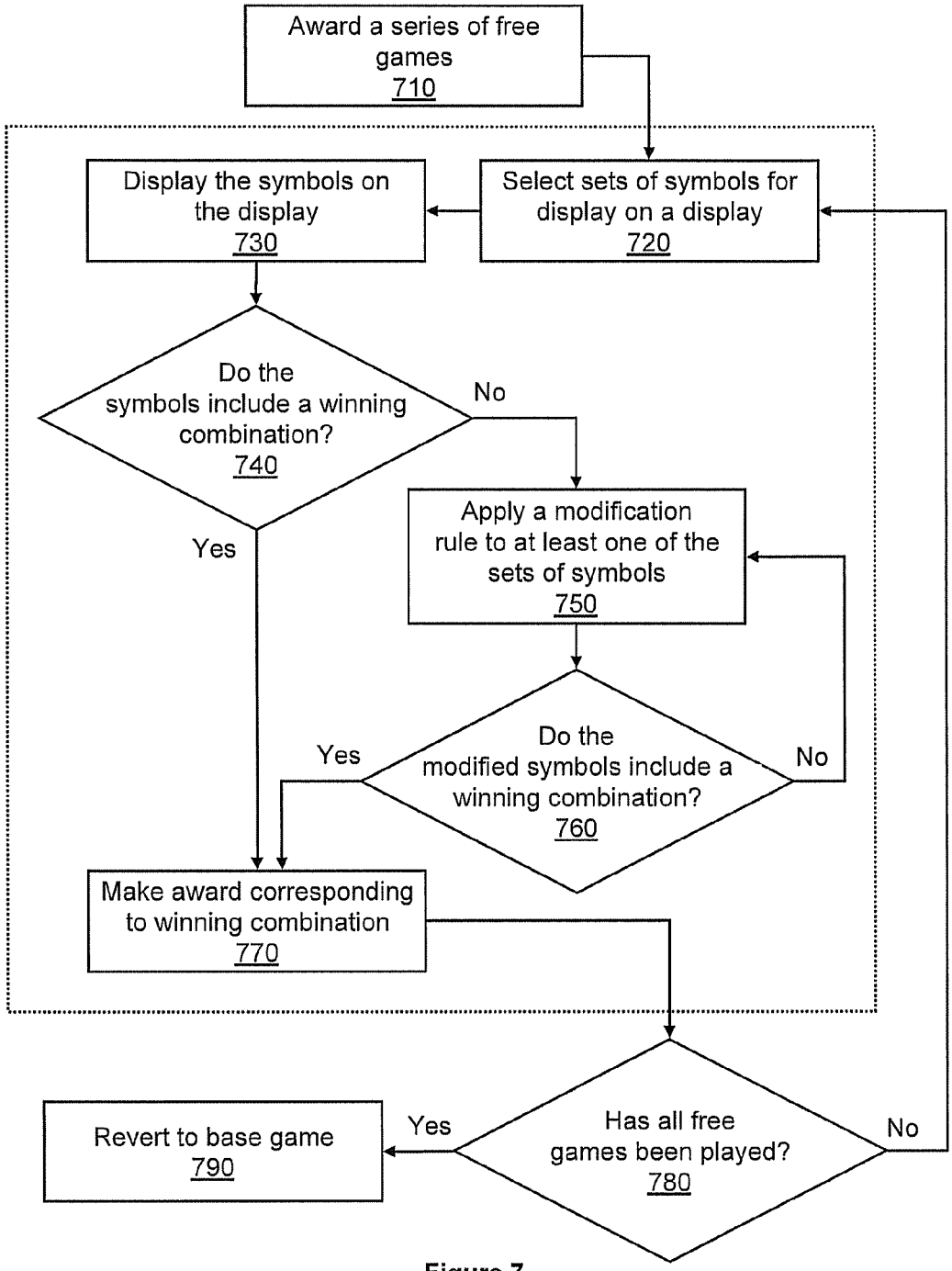
FIG. 7 is a flow chart of an embodiment.

FIG. 7 is a flowchart illustrating an embodiment of the method of gaming. At step 710, immediately upon a trigger condition (for example, a scatter combination) being met in a base game, a series of free games is awarded to the player. In the embodiment, the number of free games can vary based on the number of symbols in the scatter combination.

Steps 720 to 770 show the steps carried out in each free game. At step 720, a free game is initiated and a plurality of symbols is selected by the symbol selector 623 for display at the plurality of columns of display positions on the display 54. In the embodiment, the symbol selector 623 selects the symbols by selecting stopping positions for a plurality of reels having a predetermined sequence of symbols specified by symbol sets 642 of memory 64. As discussed above, this selection may be carried out based on pseudo-random numbers from the RNG.

At step 730, the symbols selected by the symbol selector 623 for the free game are displayed at the plurality of columns of display positions on the display 54.

At step 740, the symbol evaluator 625 determines whether the symbols displayed on the display 54 do not include any winning symbol combination. As discussed above, this may be done by evaluating whether the displayed symbols include any of the possible winning symbol combination stored in a paytable.

If the symbol evaluator 625 determines that the displayed symbols include a winning symbol combination, it immediately makes an award based on prize data 648 corresponding to the winning symbol combination 770.

Alternatively, if the symbol selector 625 determines that the displayed symbols do not include any winning symbol combination, the symbol modifier 626 immediately applies a modification rule to at least one of the sets of symbols 750. Accordingly, the symbol modifier 626 applies a modification rule only upon a determination that the displayed symbols do not include any winning symbol combination. In the embodiment, the modification rule applied by the symbol modifier 625 is selected based on modification rules 644 stored in memory. As discussed above, the modification rule may be rotating one or more reels, replacing the predetermined sequence of symbols of one or more reels etc.

After modifying the sets of symbols, the symbol evaluator 625 again determines whether the modified symbols displayed on the display 54 include a winning symbol combination 760. If the symbol evaluator 625 determines that the modified symbols include a winning symbol combination, it immediately makes an award based on prize data 648 corresponding to the winning symbol combination 770.

If the symbol evaluator 625 determines that the modified symbols do not include a winning symbol combination, the symbol modifier 626 immediately applies a modification rule again 750. Persons skilled in the art will appreciate that the modification rule may be the same as the one applied previously, or it may be different.

Steps 750 and 760 are repeated until the modified symbols displayed on the display 54 include a winning symbol combination. Thus, the symbol evaluator 625 makes an award based on prize data 648 corresponding to the winning symbol combination only upon a determination that the modified symbols include a winning symbol combination.

After step 770, the gaming system determines whether all the free games have been played 780. If all the free games have been played, the gaming system reverts back to the base game. Otherwise, the gaming system initiates the next free game in the free game series and a new set of symbols is selected for the new free game 720.

Further aspects of the method will be apparent from the above description of the system. It will be appreciated that at least part of the method will be implemented digitally by a processor. Persons skilled in the art will also appreciate that the method could be embodied in program code. The program code could be supplied in a number of ways, for example on a tangible computer readable storage medium, such as a disc or a memory (for example, that could replace part of memory 103) or as a data signal (for example, by transmitting it from a server). Persons skilled in the art, will appreciate that program code provides a series of instructions executable by the processor.

EXAMPLE

FIGS. 8A and 8B illustrate an example of the gaming system applying a modification rule to the sets of symbols displayed on display 54 in a free game of the feature game. In the example, the game is a 3×5 spinning-reel type game.

FIG. 8A is an illustration of the fifteen display positions of the feature game. The figure also shows the symbols initially selected by the symbol selector 623 for display at each of the fifteen display positions on the display 54 in the free game.

In the game, the displayed symbols are selected by selecting a stopping position in each one of five reels, each reel having a predetermined sequence of symbols specified in the symbol set 642 of memory 64, and the displayed symbols are evaluated by the symbol evaluator 623 to determine whether the displayed symbols include a winning symbol combination. In the example, the displayed symbols initially selected by the symbol selector 623 (as illustrated in FIG. 8A) do not include a winning symbol combination.

In the game, the symbol modifier 626 immediately, upon the determination by the symbol evaluator 625 that the displayed symbols do not include any winning combination during the game, applies a modification rule to the symbols. In the example, the modification rule is that four of the five reels of the game are rotated upwards by one symbol (the only reel that does not rotate is the left-most reel).

In FIG. 8A, the greyed-out area shown under the second to fifth columns of display positions illustrate the symbols that are next in sequence.

FIG. 8B illustrates the symbols displayed at the fifteen display positions on the display 64 after the symbol modifier 625 has applied the modification rule. As illustrated, the symbols displayed at the second to fifth columns of display positions has been modified after the application of the modification rule and only the symbols displayed at the left-most column of display positions were not changed.

In the example, the modified symbols displayed at the fifteen display positions include a winning symbol combination (i.e. the two "PIC1" symbols on line 8 as illustrated in FIG. 8B). Accordingly, in the game, the symbol evaluator 625 immediately makes an award corresponding to the winning symbol combination based on prize data 648 stored in memory 64 once the symbol evaluator 623 determines that the modified symbols include is the winning symbol combination.

It will be understood to persons skilled in the art of the invention that many modifications may be made without departing from the spirit and scope of the invention, in particular it will be apparent that certain features of embodiments of the invention can be employed to form further embodiments.

It is to be understood that any reference to prior art made herein does not constitute an admission that the prior art forms or formed a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic method of gaming for use with a gaming system having a game controller and a display having a plurality of display positions, the method comprising:

(a) selecting via the game controller a plurality of sets of symbols for display on said display;

(b) displaying on said display the selected symbols in said display positions;

(c) determining via the game controller whether the displayed symbols include any winning symbol combination; and (d) only upon determining that the displayed symbols do not include any winning symbol combination, repeatedly applying via the game controller a modification rule to at least one of the plurality of sets of symbols until the displayed symbols include any winning symbol combination, wherein said applying modification rule includes selecting for display via the game controller in one of said display positions at least one further symbol from symbols of the at least one set of symbols that are previously not displayed on said one of said display positions.

2. An electronic method as claimed in claim 1, and further comprising displaying each set of symbols on the display at respective ones of a plurality of columns of said display positions.

3. An electronic method as claimed in claim 1, and further comprising selecting each symbol from a predetermined set of symbols representing a reel of symbols.

4. An electronic method as claimed in claim 3, wherein the reel is a physical, substantially circular reel.

5. An electronic method as claimed in claim 3, and further comprising implementing the reel in software as a virtual reel.

6. An electronic method as claimed in claim 3, and wherein the modification rule includes rotating one of the reels.

7. An electronic method as claimed in claim 3, and wherein the modification rule includes rotating a plurality of reels.

8. An electronic method as claimed in claim 3, wherein the modification rule includes replacing the predetermined set of symbols of one of the plurality of reels of symbols by a separate predetermined set of symbols.

9. An electronic method as claimed in claim 1, and further comprising (e) making an award corresponding to the winning symbol combination.

10. An electronic method as claimed in claim 9, and further comprising conducting a base game and determining whether a trigger condition is met in the base game, and carrying out (a) to (e) as part of a feature game upon the trigger condition being met in the base game.

11. An electronic method as claimed in claim 10, wherein the feature game comprises a series of free games, and said method further comprising carrying out (a) to (e) during each of a plurality of free games.

12. An electronic method as claimed in claim 11, further comprising reverting back to the base game upon the completion of the series of free games.

13. An electronic method as claimed in claim 11, and further comprising using at least one of a plurality of trigger conditions and determining the number of free games dependent on which of the trigger conditions occurs.

14. An electronic method as claimed in claim 10, wherein the base game is a spinning-reel type game.

15. An electronic method as claimed in claim 10, and further comprising including a scatter combination in the trigger condition.

16. A gaming system, comprising:

a display having a plurality of display positions;

a symbol selector configured to select a plurality of sets of symbols for display on the display, and wherein said display is configured to display the selected set of symbols at said display positions;

a symbol evaluator configured to determine whether the displayed symbols include any winning symbol combination; and a symbol modifier configured to, only upon a determination that the displayed symbols do not include any winning symbol combination, repeatedly apply a modification rule to at least one of the plurality of sets of symbols until the displayed symbols include any winning symbol combination, wherein said modification rule includes selecting for display in one of said display positions at least one further symbol from symbols of the at least one set of symbols that are previously not displayed on said one of said display positions.

17. A gaming system as claimed in claim 16, wherein each set of symbols is displayed on the display at respective ones of a plurality of columns of display positions.

18. A gaming system as claimed in claim 16, wherein each symbol is selected from a predetermined set of symbols representing a reel of symbols.

19. A gaming system as claimed in claim 18, wherein the reel is a physical, substantially circular reel.

20. A gaming system as claimed in claim 18, wherein the reel is implemented in software as a virtual reel.

21. A gaming system as claimed in claim 18, wherein the modification rule is that one of the reels is rotated.

22. A gaming system as claimed in claim 18, wherein the modification rule is that a plurality of reels are rotated.

23. A gaming system as claimed in claim 18, wherein the modification rule is that the predetermined set of symbols of one of the plurality of reels of symbols are replaced by a separate predetermined set of symbols.

24. A gaming system as claimed in claim 16, wherein the gaming system is configured to make an award.

25. A gaming system as claimed in claim 16, wherein:

the gaming system is configured to conduct a base game and a feature game;

the symbol evaluator comprises a trigger monitor configured to determine whether a trigger condition is met in the base game; and the symbol modifier is configured to apply the modification rule only during the feature game.

26. A gaming system as claimed in claim 25, wherein the feature game comprises a series of free games.

27. A gaming system as claimed in claim 26, wherein the gaming system is configured to revert back to the base game upon the completion of the series of free games.

28. A gaming system as claimed in claim 26, wherein there are a plurality of trigger conditions and the number of free games is dependent on which of the trigger conditions occurs.

29. A gaming system as claimed in claim 25, wherein the base game is a spinning-reel type game.

30. A gaming system as claimed in claim 25, wherein the trigger condition is that there is a scatter combination.

31. A game controller for a gaming system, the game controller configured to:

select a plurality of sets of symbols for display on a display having a plurality of display positions;

cause said display to display the selected symbols in said display positions;

determine whether the displayed symbols include any winning symbol combination; and only upon determining that the displayed symbols do not include any winning symbol combination, repeatedly apply a modification rule to at least one of the plurality of sets of symbols until the displayed symbols include any winning symbol combination, wherein said apply modification rule includes selecting for display in one of said display positions at least one further symbol from symbols of the at least one set of symbols that are previously not displayed on said one of said display positions.

32. A game controller as claimed in claim 31, wherein each set of symbols is displayed on the display at respective ones of a plurality of columns of display positions.

33. A game controller as claimed in claim 31, wherein each symbol is selected from a predetermined set of symbols representing a reel of symbols.

34. A game controller as claimed in claim 33, wherein the reel is a physical, substantially circular reel.

35. A game controller as claimed in claim 33, wherein the reel is implemented in software as a virtual reel.

36. A game controller as claimed in claim 33, wherein the modification rule is that one of the reels is rotated.

37. A game controller as claimed in claim 33, wherein the modification rule is that a plurality of reels are rotated.

38. A game controller as claimed in claim 33, wherein the modification rule is that the predetermined set of symbols of one of the plurality of reels of symbols are replaced by a separate predetermined set of symbols.

39. A game controller as claimed in claim 31, wherein the game controller is configured to make an award corresponding to the winning symbol combination.

40. A game controller as claimed in claim 39, wherein the game controller is configured to:

conduct a base game and a feature game;

determine whether a trigger condition is met in the base game; and apply the modification rule only during the feature game.

41. A game controller as claimed in claim 40, wherein the feature game comprises a series of free games.

42. A game controller as claimed in claim 41, wherein the game controller is configured to revert back to the base game upon the completion of the series of free games.

43. A game controller as claimed in claim 41, wherein there are a plurality of trigger conditions and the number of free games is dependent on which of the trigger conditions occurs.

44. A game controller as claimed in claim 40, wherein the base game is a spinning-reel type game.

45. A game controller as claimed in claim 40, wherein the trigger condition is that there is a scatter combination.

46. A gaming machine comprising:

a cabinet;

a display having a plurality of display positions, mounted to the cabinet, and configured to display a plurality of sets of symbols at said display positions to a player;

a game play mechanism mounted to the cabinet, the game play mechanism operable by the player to initiate a play of a game; and a game controller mounted within the cabinet and communicatively coupled to the display and the game play mechanism, the game controller comprising:

a symbol selector configured to select the plurality of sets of symbols for display on the display to the player, and wherein said display is configured to display the selected set of symbols at said display positions;

a symbol evaluator configured to determine whether the displayed symbols on the display include any winning symbol combination; and a symbol modifier configured to, only upon a determination that the displayed symbols on the display do not include any winning symbol combination, repeatedly apply a modification rule to at least one of the plurality of sets of symbols until the displayed symbols on the display include any winning symbol combination, wherein said apply modification rule includes selecting for display in one of said display positions at least one further symbol from symbols of the at least one set of symbols that are previously not displayed on said one of said display positions.

* * * * *